US005762294A

United States Patent [19]

Jimmerson

[11] Patent Number: 5,762,294

[45] Date of Patent: Jun. 9, 1998

[54] WING DEPLOYMENT DEVICE

[75] Inventor: Gary T. Jimmerson, Limestone, Ala.

[73] Assignee: The United States of America as represented by the Secretary of the Army, Washington, D.C.

[21] Appl. No.: 829,366

[22] Filed: Mar. 31, 1997

[51] Int. Cl.[6] ..... B64C 3/56; F42B 10/14; F42B 15/01

[52] U.S. Cl. ..... 244/49; 244/3.27; 244/3.28; 244/3.29

[58] Field of Search ..... 244/3.24, 3.27, 244/3.28, 3.29, 49

[56] References Cited

U.S. PATENT DOCUMENTS

| | | | |
|---|---|---|---|
| 2,538,602 | 1/1951 | Taylor et al. | 244/49 |
| 3,093,075 | 6/1963 | Garrett et al. | 102/50 |
| 3,711,040 | 1/1973 | Carver | 244/3.21 |
| 4,453,426 | 6/1984 | Groutage | 244/49 |
| 4,667,899 | 5/1987 | Wedertz | 244/49 |
| 4,778,129 | 10/1988 | Byford | 244/49 |
| 4,779,820 | 10/1988 | Lambert | 244/49 |

*Primary Examiner*—Virna Lissi Mojica
*Attorney, Agent, or Firm*—Hugh P. Nicholson; Freddie M. Bush; Hay Kyung Chang

[57] ABSTRACT

The wing deployment device is a simple mechanical device that resides in the hollow of the wing and combines a primary and a secondary rotational motions to translate the wing from its stored position to its deployed position. The primary rotational motion occurs when the initial restraint holding the wing to the missile body is severed and the wing, under the influence of the spring component of the device, rotates to a position normal to the missile body axis. After the lapse of a pre-determined duration of time, the secondary rotational motion is started when the tensile force of the spring is transfered to the swivel component via the kevlar rope coupled between the spring and the swivel. As the kevlar rope that is wrapped around the cylindrical shaft component unwinds, the swivel rotates and transmits the rotational motion to the base component which is rigidly coupled to the wing and, in turn, imparts the motion to the wing, thereby engaging the wing in the secondary rotational motion to be deployed.

10 Claims, 7 Drawing Sheets

WING DEPLOYMENT DEVICE

DEDICATORY CLAUSE

The invention described herein may be manufactured, used and licensed by or for the Government for governmental purposes without the payment to me of any royalties thereon.

BACKGROUND OF THE INVENTION

In missilery, improvements are constantly sought for more efficient and economical ways to deploy wings from their initial inactive position.

SUMMARY OF THE INVENTION

The instant wing deployment device produces the necessary rotational and translational motions to move a missile wing or fin from its initial inactive position to the deployed position. The device accomplishes this by a combined utilization of a spring of a given tensility and a length of kevlar rope twisted to store the rotary energy until released. The primary rotary motion is initiated when the physicial restraint holding the wing to the missile body is severed and thus the wing, under the influence of the spring, is freed to rotate away from the missile body. After a predetermined time lapse but prior to the completion of the primary motion, the secondary motion is begun when the twisted rope follows its natural tendency to straighten itself. This secondary motion drives the wing to a position that is parallel with the airstream so as to produce lift. Finally, the tension of the spring causes the base of the wing deployment device to slide down the shaft of the device and lock in position upon making contact with the surface of the missile body, thereby preventing further rotary motion of the wing after deployment.

DESCRIPTION OF THE PREFERRED EMBODIMENT

Figure 1:
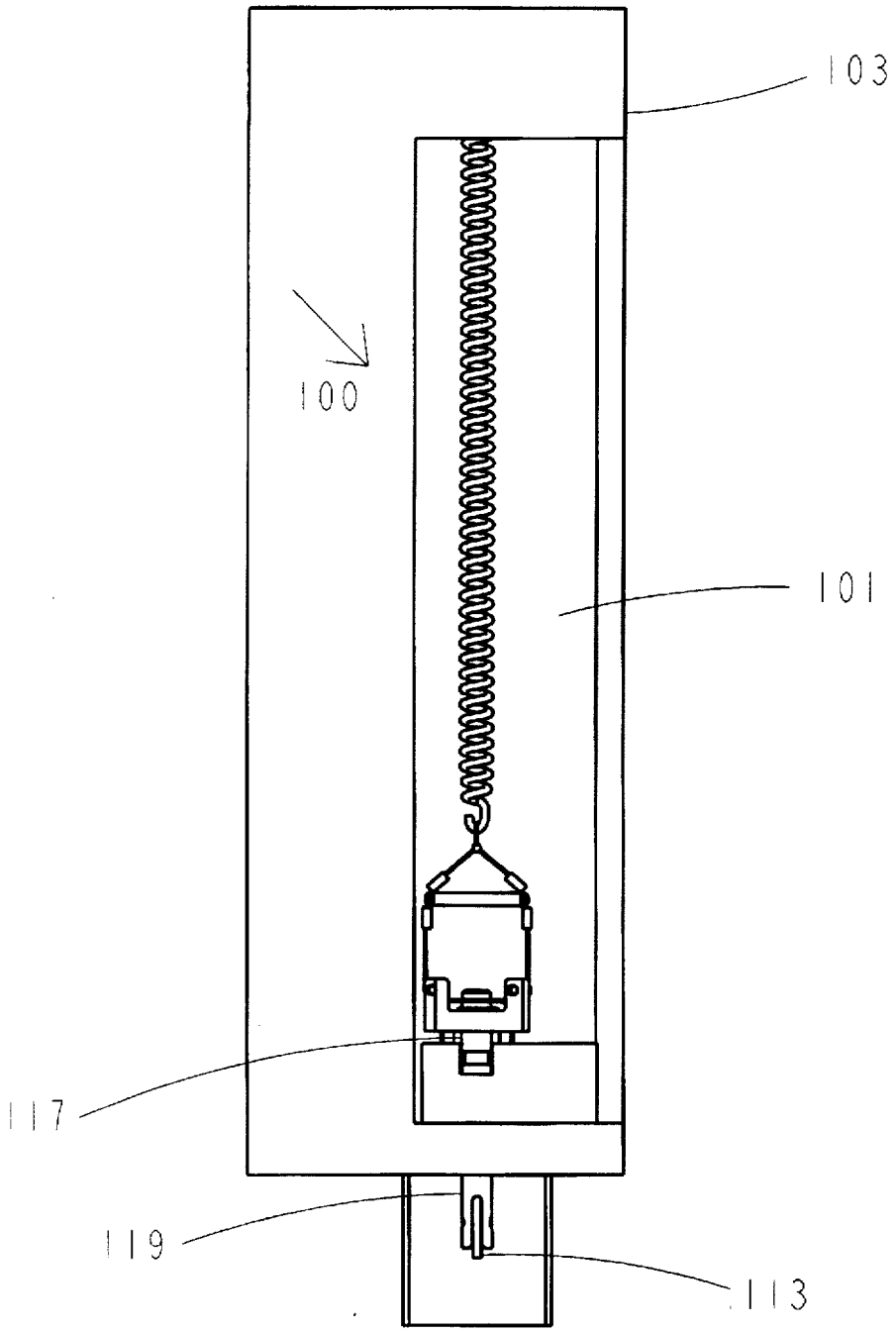
FIG. 1 shows the placement of the wing deployment device inside the hollow of the wing.

Referring now to the drawing wherein like numbers represent like parts in each of the several figures, the structure and operation of the wing deployment device are explained in detail.

Figure 6:
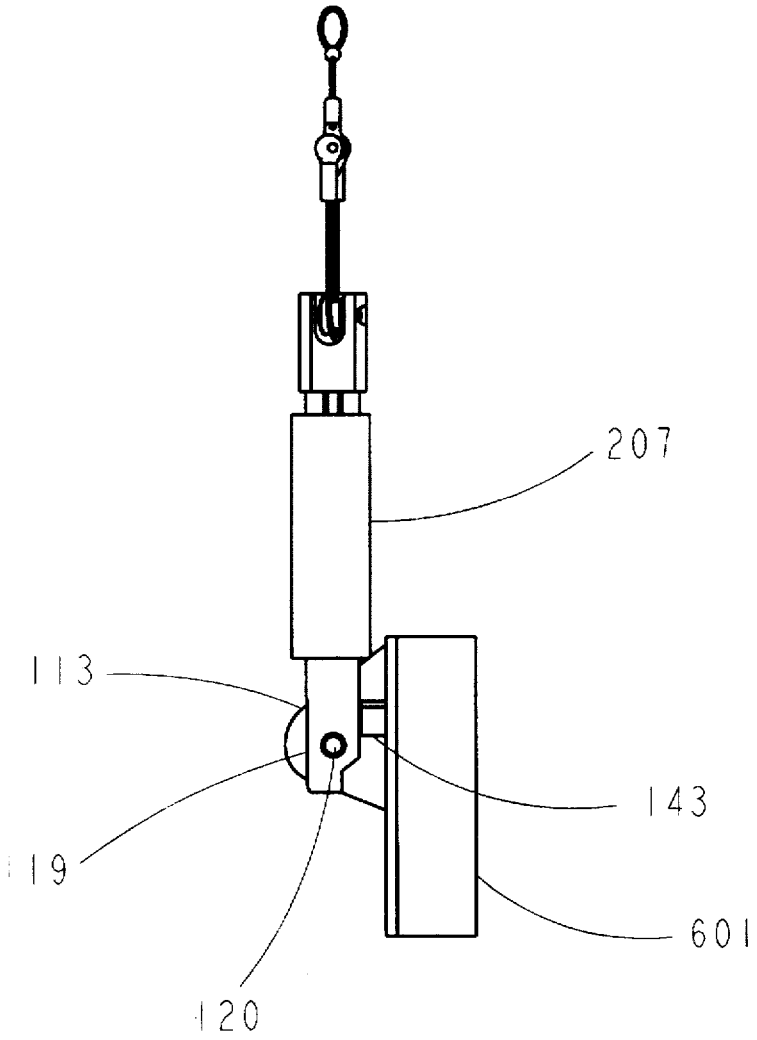
FIG. 6 is a side view of the wing deployment device showing the position of the stopping means.
Figure 7:
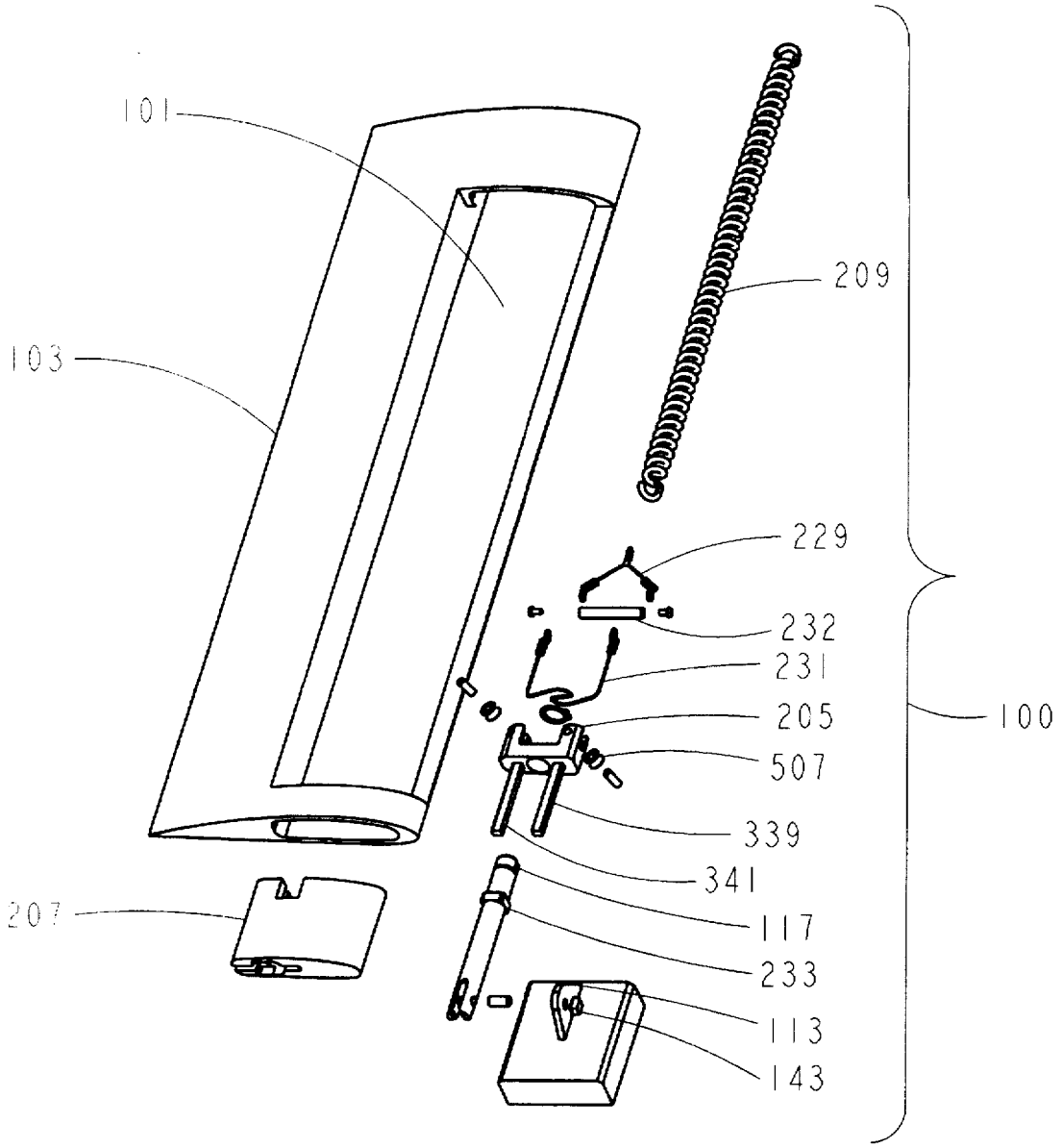
FIG. 7 is an exploded view of the wing deployment device.

FIG. 1 shows the placement of most of wing deployment device 100 inside hollow 101 of missile wing 103. Only rib 113, bottom end 119 of cylindrical shaft 117 and stopping means 143, depicted in FIG. 6, are shown to be outside the hollow of the wing. Rib 113 is fixedly attached to the exterior of the missile body. The device, as shown detached from the wing in FIG. 2, has first hook 225 at first end 226 of spring 209. For the wing deployment device to function as intended, the device is mechanically anchored by extending the spring by a predetermined amount and connecting first hook 225 to a suitable protrusion (not shown) in the interior of wing 103. The wing itself is held to the missile body (also not shown) by a suitable restraining means, usually some sort of a tie, until the wing is ready to be deployed.

Figure 2:
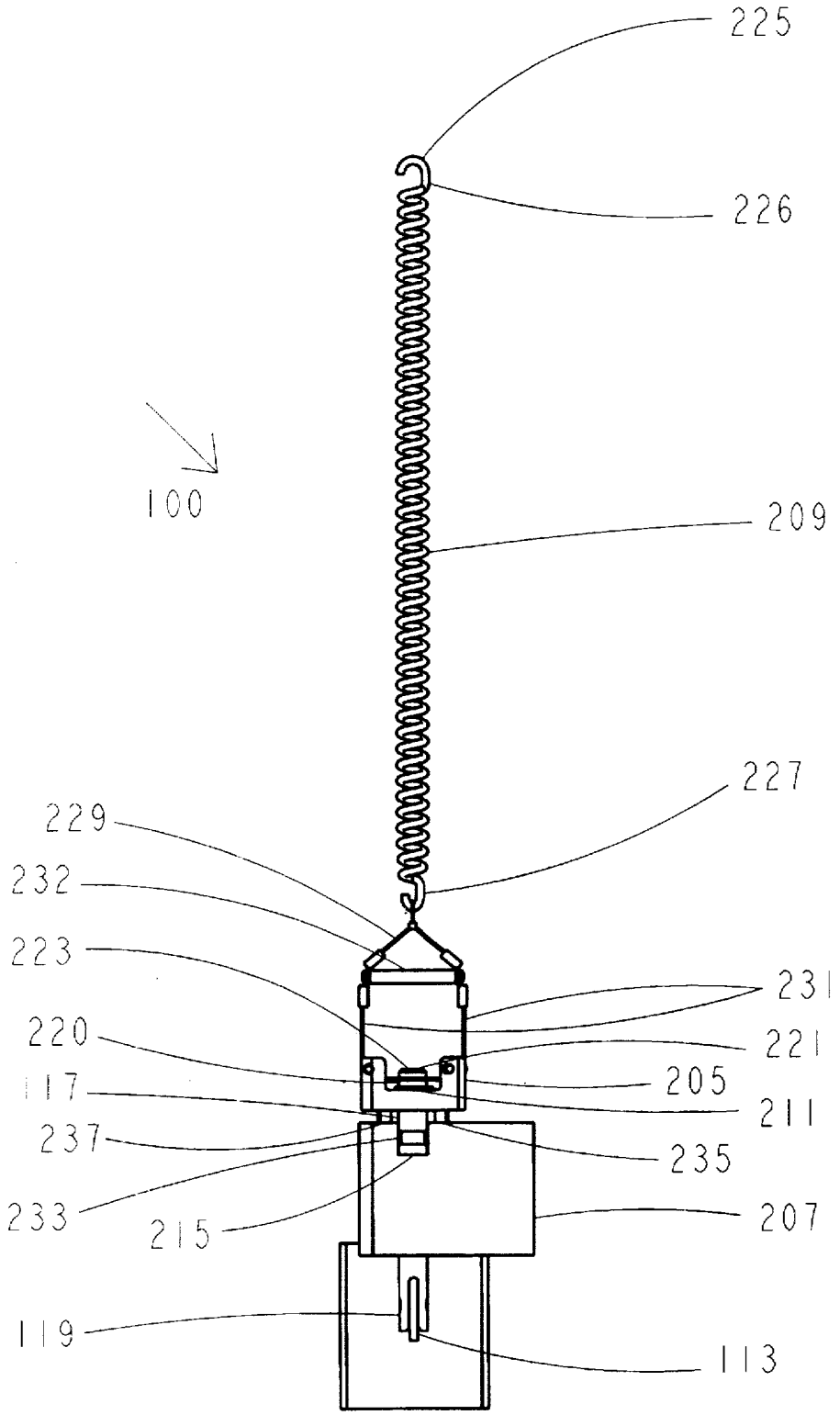
FIG. 2 illustrates the structure of the wing deployment device in detail.

When, upon the severance of the restraining means, the wing is released from its initial attachment to the missile body, spring 209 inside the hollow of the wing tries to return to its natural unextended state, thereby generating and exerting a force on the wing and base 207. Wing 103 and base 207 are rigidly fastened together by some suitable means, typically an adhesive bond, and consequently move as a unit. The primary rotational motion is the result of the interaction between the linear translation of base 207 which occurs along the axis of shaft 117 and the inclined rib 113. As illustrated in FIG. 2, shaft 117 is movably coupled at its bottom end 119 by pin 120 (shown in FIG. 6) to rib 113 so that the shaft can rotate as the base, through which the shaft is inserted, moves along the inclined edge of rib 113 in response to the force of the spring on the base. The resultant force between the rib and the base generates an over-center moment, or torque, about the rib on the shaft. As shown in further detail in FIG. 4, the shaft is inserted into first cylindrical hole 211 through rectangular plate 513 of swivel 205 as well as into second cylindrical hole 215 through base 207. When base 207 slides along the inclined edge of rib 113, the base motivates the wing into a primary rotational motion away from the missile body. The shaft comes to a halt when it comes into contact with stop 143, illustrated in FIG. 6, that abuts from the missile body and is adjacent to the rib. Two stops, one on either side of the rib, are positioned at a place calculated jointly to prevent the movement of the shaft beyond a pre-determined point. This usually means that the primary rotational motion of the wing terminates when the wing is normal to the axis of the missile body.

After a certain time lapse from the initiation of the primary rotational motion, a secondary rotational motion is begun that involves the rotation of base 207 around cylindrical shaft 117. A given time lapse is desired to avoid a potential impact of wing 103 on the missile body and is assured by the placement of square ring 233 at a pre-selected point along the length of shaft 117. The square ring prevents the base from rotating about the shaft until the base becomes free of the ring. Thus, the secondary rotational motion would not start until base 207 has slid along the inclined edge of rib 113 sufficiently to raise the square ring above the base, thereby freeing the base to rotate about the shaft unobstructed. The duration of the time lapse between the primary and secondary rotational motions is controlled by the placement of the square ring along the length of the shaft as well as the tensility of spring 209.

Figure 3:
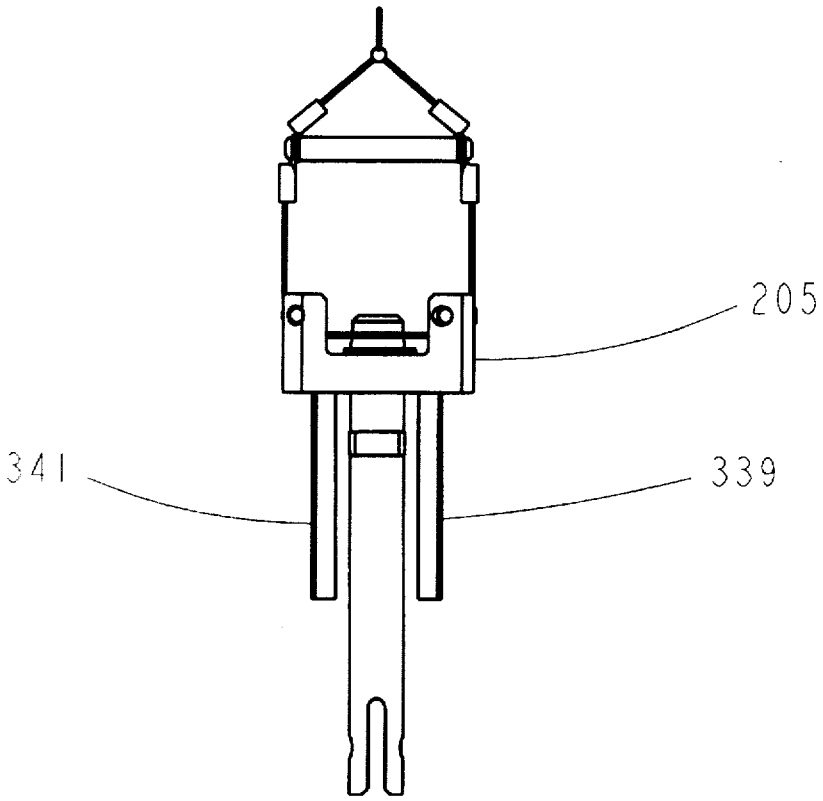
FIG. 3 shows the two arms extending from the swivel.
Figure 4:
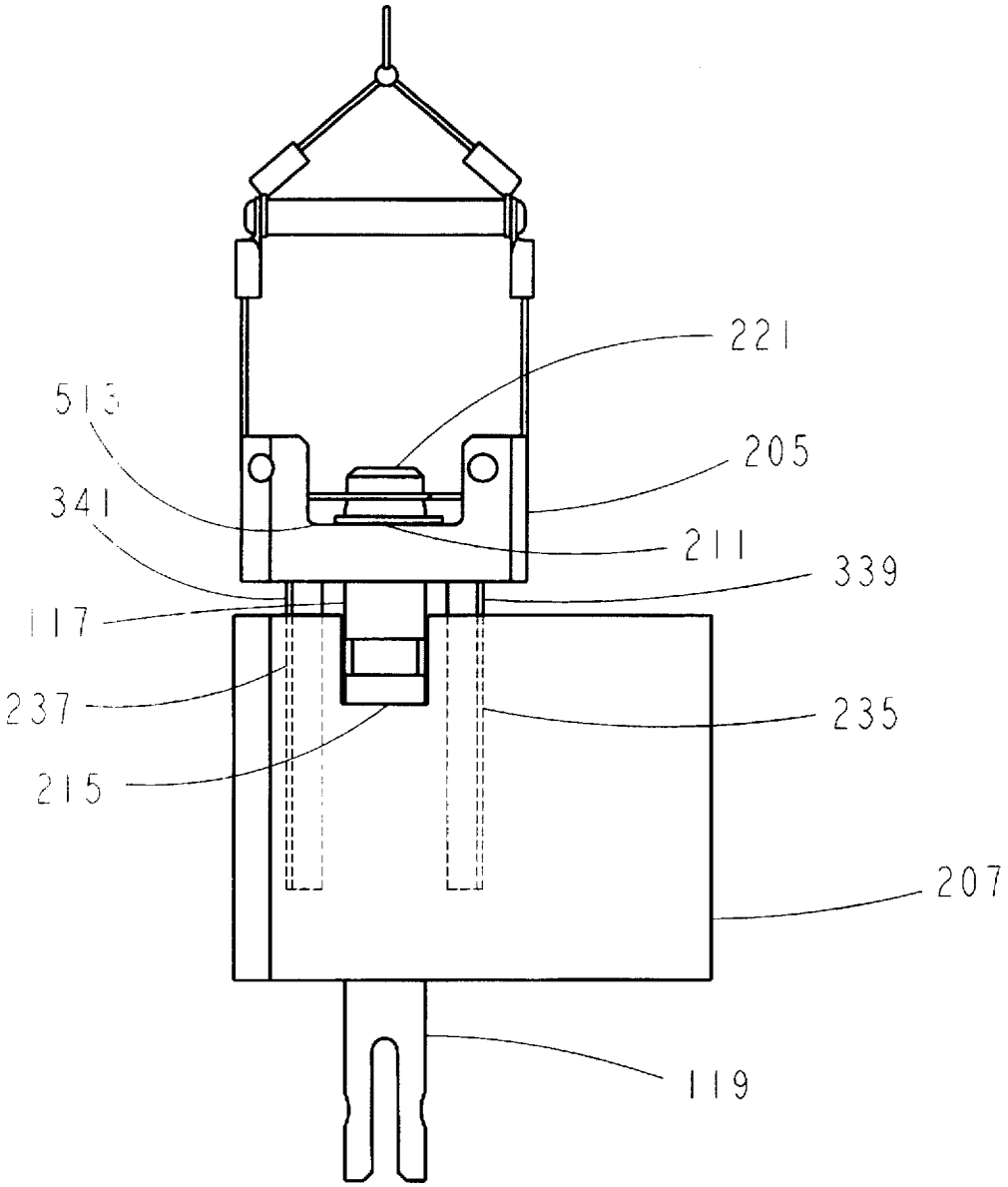
FIG. 4 is a diagram depicting the swivel and the base coupled together via the cylindrical shaft and the two arms.
Figure 5:
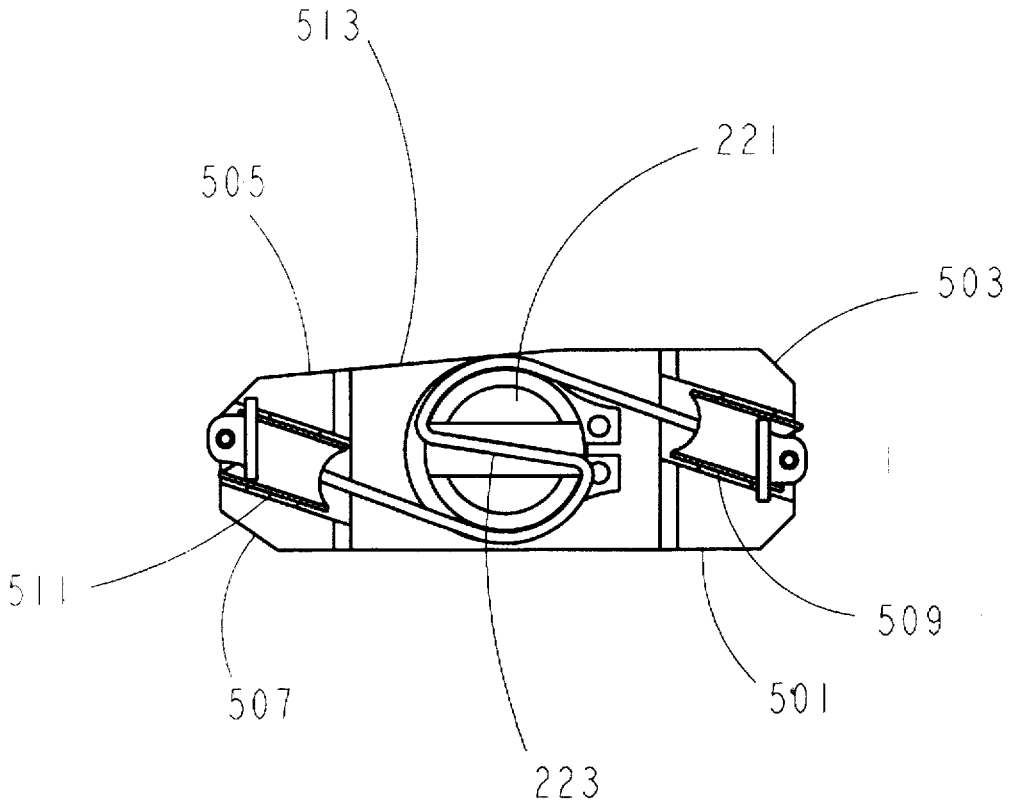
FIG. 5 is a top view of the arrangement of the kevlar rope around the cylindrical shaft and under the bushings.

The secondary rotational motion is accomplished as follows: A loop of suitable cable material, such as kevlar, is hooked onto second hook 227 of spring 209. Therefrom the cable assumes an upside-down Y-shape 229 and the two legs of the Y-shape extend down to opposite ends of spreader bar 232. Another kevlar segment, U-shaped segment 231, extends from one end of the spreader bar. Thence, as depicted in detail in FIG. 5, it is routed under first bushing 509, around the circumference of top end 221 of cylindrical shaft 117 and through notch 223 that is incorporated into top end 221 before being routed under second bushing 511 and back up to the opposite end of the spreader bar. The routing of the U-shaped segment around the circumference of top end 221 of shaft 117 stores rotational energy in the rope later to be released. Supports 501, 503, 505 and 507 which are integral parts of swivel 205 are fixedly attached each at each of the four corners of rectangular plate 513 and lend support to bushings 509 and 511. When the tensile force from spring 209 is exerted on the spreader bar, the resulting force acts on the two segments of the kevlar rope. This resulting force is then further transmitted through the rope and around shaft 117, thereby inducing a torque on swivel 205 to which the swivel is coupled. As the U-shaped segment of kevlar rope unwinds from around the circumference of top end 221, the unwinding motion creates a secondary rotation of the wing deployment device. As illustrated in FIGS. 3 and 4, first arm 339 and second arm 341 extend down from swivel 205 and reside in first oval-shaped slot 235 and second oval-shaped slot 237, respectively, of base 207, the slots boring a part way through the base. The arms function to transfer the torque of the swivel to the base. This transfer imparts the secondary rotational motion to the wing, if, at the time, the primary rotational motion has progressed sufficiently to raise square ring 233 above base 207. The secondary rotational motion drives the wing to a position parallel with the airstream to produce lift. Thus for a certain period of time prior to the completion of the primary rotational motion, the primary rotational motion and the secondary rotational motion occur simultaneously, thus allowing lower energy use and quicker deployment time.

During the primary rotational motion, a linear translation of the wing occurs along the axis of shaft 117. Therefore, when square ring 233 is above base 207, because of the linear translation of the wing, the wing is free to perform the secondary rotational motion. This relationship between the square ring and the base allows the control of the sequencing of the primary and secondary rotational motions. After the secondary rotational motion is complete, the wing makes a second and final linear translation when base 207 slides down over rib 113, thereby locking the wing down securely onto the missile body.

The above-described wing deployment device allows the wing, prior to deployment, to be stored next to the missile which results in reduced packaging of the missile assembly in crates, containers or other missiles or rockets. The device also has a low part count to perform the desired erection of the wing from its stored position to its deployed position. Low part count increases the reliability of the device and lowers the manufacturing cost of the device while enabling the packaging of the device in a small size.

The wing deployment device can be used in any situation requiring an aft folding or forward folding wing or fin deployment device.

Although a particular embodiment and form of this invention has been illustrated, it is apparent that various modifications and embodiments of the invention may be made by those skilled in the art without departing from the scope and spirit of the foregoing disclosure. Accordingly, the scope of the invention should be limited only by the claims appended hereto.

I claim:

1. A device for deploying a hollowed wing of a flying object upon the severance of the initial restraint of the wing, said device residing in the hollow of the wing and the flying object having a rib protruding from the exterior surface thereof, said device comprising:

a swivel having a first cylindrical hole therethrough; a base positioned between said rib and said swivel, said base having a second cylindrical hole therethrough and being rigidly coupled to the interior surface of the wing; a cylindrical shaft inserted through said cylindrical holes so as to permit said swivel and base to rotate thereabout, said shaft having a bottom end that is movably attached to said rib and a top end incorporating a notch, said top end being affixed to said swivel such that said notch protrudes above said swivel; a spring having a pre-determined tensility and a first and a second hooks, said spring being fixedly coupled by said first hook to the interior surface of the wing; a means for transferring the tensile strength of said spring, said means being coupled between said swivel and said second hook of said spring such that upon the severance of the initial restraint of the wing, the tensile strength of said spring is transferred by said transferring means to said swivel and therefrom further transferred to cause said base to move along said rib, thereby motivating the wing into a primary rotational motion away from the surface of the flying object, said transferring means, in cooperation with said notch, further being capable of storing and subsequently releasing rotational energy in response to said movement of said base along said rib so as to cause a secondary rotational motion of said base around said shaft thereby allowing the wing to deploy.

2. A deploying device as described in claim 1, wherein said device further comprises a square ring, said ring being fixedly wrapped around said shaft to regulate the initiation of said secondary rotational motion relative to said primary rotational motion.

3. A deploying device as described in claim 2, wherein said base further comprises a pair of slots, each of said slots being located on either side of said second cylindrical hole and boring a part way through said base.

4. A deploying device as described in claim 3, wherein said swivel comprises a rectangular horizontal plate having said first cylindrical hole at the center thereof, a means for sustaining and guiding a cable, said means being attached to said plate and functioning in cooperation with said notch at said top end of said shaft and a pair of arms, said arms extending from said plate and being inserted into said slots such that said base and said swivel are rotatable in the same direction at the same rate.

5. A deploying device as described in claim 4, wherein said sustaining and guiding means comprises a pair of bushings and two pairs of supports, said supports being fixedly attached at the four corners of said rectangular plate and each pair of said supports supporting one of said bushings such that said bushings do not touch the surface of said plate.

6. A deploying device as described in claim 5, wherein said means for transferring the tensile strength of said spring comprises a Y-shaped segment and a U-shaped segment of suitable cable and a spreader bar connecting said segments while maintaining the vertical elements of said U-shaped segment separate, said Y-shaped segment having a small loop and being coupled to said second hook of said spring by said loop and said U-shaped segment passing under said bushings and through said notch.

7. A deploying device as described in claim 6, wherein said cable is braided kevlar rope.

8. A deploying device as described in claim 7, wherein said slots in said base are oval-shaped.

9. A deploying device as described in claim 8, wherein said device further comprises a means for stopping the movement of said shaft along said rib at a pre-determined position along said rib, said stopping means being adjacent to said rib and being fixedly attached to the exterior surface of the flying object.

10. A device for deploying a hollowed wing of a flying object upon the severance of the initial restraint of the wing maintaining the wing in parallel position with the axis of the flying object, said device mostly residing in the hollow of the wing and comprising:

a platform; a means for securing said platform onto said flying object; a rib having an inclined edge, said rib protruding from the center of said platform; a swivel having a first cylindrical hole therethrough; a base positioned between said rib and said swivel, said base being fixedly coupled to the interior surface of the wing, said base further having a second cylindrical hole therethrough and being rotatable in unison with said swivel; a cylindrical shaft inserted through said cylindrical holes so as to permit said swivel and base to rotate thereabout, said shaft having a bottom end that is movably attached to said rib and a top end incorporating a notch, said top end being affixed to said swivel such that said notch is above said swivel; a spring having a pre-determined tensility and a first and a second hooks, said spring being fixedly coupled by said first hook to the interior surface of the wing; a means for transferring the tensile strength of said spring, said means being coupled between said swivel and said second hook of said spring such that upon the severance of the initial restraint of the wing, the tensile strength of said spring is transferred by said transferring means to said swivel and therefrom further transferred to cause said base to move along said inclined edge of said rib, thereby motivating the wing into a primary rotational motion away from the surface of the flying object, said transferring means, in cooperation with said notch, further being capable of storing and subsequently releasing rotational energy in response to said movement of said base along said rib so as to cause a secondary rotational motion of said base and swivel around said shaft, thereby allowing the wing to deploy.

* * * * *